US006917272B2

(12) United States Patent
Valdemarsson

(10) Patent No.: US 6,917,272 B2
(45) Date of Patent: Jul. 12, 2005

(54) ELECTRIC DEVICE

(75) Inventor: Stefan Valdemarsson, Lidköping (SE)

(73) Assignee: Abb AB, Västerås (SE)

( * ) Notice: Subject to any disclaimer, the term of this patent is extended or adjusted under 35 U.S.C. 154(b) by 93 days.

(21) Appl. No.: 10/362,175

(22) PCT Filed: Aug. 29, 2001

(86) PCT No.: PCT/SE01/01826

§ 371 (c)(1),
(2), (4) Date: Feb. 21, 2003

(87) PCT Pub. No.: WO02/19353

PCT Pub. Date: Mar. 7, 2002

(65) Prior Publication Data

US 2003/0160676 A1 Aug. 28, 2003

(30) Foreign Application Priority Data

Aug. 29, 2000 (SE) ..... 0003037

(51) Int. Cl.[7] ..... H01F 38/20
(52) U.S. Cl. ..... 336/174; 336/196
(58) Field of Search ..... 336/173–175, 336/180–185, 220–222, 196–198, 206–208

(56) References Cited

U.S. PATENT DOCUMENTS 3,939,449 A 2/1976 Boyd et al.
3,959,761 A * 5/1976 Graul ..... 336/84 R
4,112,041 A * 9/1978 Lonseth et al. ..... 264/263
5,901,433 A 5/1999 Moon et al.
2002/0047439 A1 * 4/2002 Leijon et al. ..... 310/179
2002/0047440 A1 * 4/2002 Leijon et al. ..... 310/179

FOREIGN PATENT DOCUMENTS

EP 0080974 A1 6/1983
EP 0 696 033 A2 * 2/1996
GB 1502490 A 3/1978
JP 09-288917 * 11/1997

* cited by examiner

*Primary Examiner*—Tuyen T Nguyen
(74) *Attorney, Agent, or Firm*—Venable LLP; Eric J. Franklin

(57) ABSTRACT

An electric device comprising at least one core (5, 10) of magnetic material and a high-voltage winding (16) in the form of an electric conductor wound around the core, and a method for manufacturing such a device is described. The device comprises a first insulating layer (14) of a solid, electrically insulating material which encloses the core (10) and which is arranged b between the core (10) and the high-voltage winding (16), and a second insulating layer (18) of a solid, electrically insulating material which encloses the high-voltage winding (16), a semiconductive layer is arranged on both sides of each of the electrically conductive layers.

25 Claims, 8 Drawing Sheets

ELECTRIC DEVICE

FIELD OF THE INVENTION

The present invention relates to an electric device comprising at least one core of magnetic material and a high-voltage winding wound around the core as well as a method for manufacturing such a device. More particularly, the invention concerns a non-rotating electric device.

BACKGROUND ART

Electric devices comprising a high-voltage winding are used to a large extent in various applications in electricity distribution networks. Examples of non-rotating devices of this kind are transformers and inductors. Traditionally, transformers have included a core of magnetic material around which a high-voltage winding and a low-voltage-winding have been arranged. Traditionally, the magnetic core and its windings have been arranged in a oil-filled container. Such a transformer is relatively big.

High-voltage here means voltages above 1 kV.

In many cases, there is not much space in the places where a transformer is to be located. This is the case, for example, when the transformer is to be located in a built-up area or inside a building. In those cases, it would have been desirable to have a less bulky transformer or a transformer with a geometrical shape that is adapted to the space available. The transformer could then be arranged, for example, in an existing cable trench, along an existing wall or under a roof. In many cases, it is also desirable to provide a transformer with lower weight, for example when the transformer is to be located at the top of a power pole.

When distributing power to dwellings, it is desirable to step down the voltage to normal mains voltage as late as possible in order to minimize the losses. In most cases, the voltage is then stepped down from about 10 kV to 400 V. In many countries, such transformers are usually arranged at the top of a pole. Because of their size, there is a considerable risk that they are blown down, which entails expensive maintenance and repair work. As in the previous example, it is here desirable to minimize the size of the transformer.

Consequently, there is a need for an electric device with smaller dimensions or with different geometrical shape than existing devices to avoid the above problems.

SUMMARY OF THE INVENTION

An object of the present invention is to provide an electric device which is such that its outer dimensions can be made small or its efficiency increased.

A further object of the present invention is to provide an electric device whose shape can be adapted to the space in which it is intended to be located.

Another object of the present invention is to provide a method for manufacturing an electric device according to the invention.

A further object of the present invention is to provide use of an electric device according to the invention.

These objects are achieved by an electric device, a method and a use according to the appended claims.

An electric device according to the invention comprises at least one core of magnetic material and a high-voltage winding in the form of an electric conductor wound around the core. The electric device is characterised in that it comprises a first insulating layer of a solid, electrically insulating material which encloses the core and which is arranged between the core and the high-voltage winding, semiconductive layers being arranged on both sides of the first electrically insulating layer. The electric device further comprises a second insulating layer of a solid, electrically insulating material which encloses the high-voltage winding, semi-conductive layers being arranged on both sides of the second insulating layer.

An electric device according to the invention is preferably a high-power device such as a power transformer or a distribution transformer. An electric device according to the invention is preferably intended for power levels above 10 kVA and preferably above 50 kVA. Power here means the maximum power consumption of the device.

The electric conductor is preferably wound around the core in substantially tangential direction relative to the longitudinal axis of the core.

The core is preferably of substantially cylindrical shape, and advantageously of substantially circular-cylindrical shape. For practical reasons, however, the shape of the core may differ from this shape. Advantageously, the core is formed of a plurality of metal sheets, in which case the core has a stepped edge.

By using a solid insulating material it is possible to considerably reduce the distance between the high-voltage winding and the core. A significantly smaller device as compared to what is possible using prior art or a device with significantly higher efficiency can thus be achieved.

The insulating layers preferably consist of polymer tubing. This allows the tubes to be manufactured in a continuous process by means of extrusion, which is a well established manufacturing technique. Alternatively, the insulation can be extruded directly onto the core.

When manufacturing the electric device, it is difficult to prevent air pockets from forming between the insulating layers and the high-voltage winding. Air pockets will cause corona to appear, and this may eventually eat away at the insulation. This is a problem, primarily at voltages above 1–2 kV and, particularly, at voltages above 10 kV. One way of avoiding the problem is to use a corona-resistant material in the insulating layers. However, it is not easy to find corona-resistant materials that also have a high electric strength.

To make it possible to benefit as much as possible from the use of a solid insulating material also at high voltages, the electric device further comprises semiconductive layers that are arranged on both sides of each of the electrically insulating layers.

It is preferred that the electric device comprises a first semiconductive layer which is in contact with the first insulating layer and enclosed by the first insulating layer, a second semiconductive layer which is arranged between the first insulating layer and the high-voltage winding in contact with both the first layer and the high-voltage winding, a third semiconductive layer which is arranged between the second insulating layer and the high-voltage winding in contact with both the second insulating layer and the high-voltage winding, and a fourth semiconductive layer which is in contact with and encloses the second insulating layer.

For optimal operation, it is essential that the semiconductive layers be in contact with the respective insulating layers.

Preferably, the semiconductive layers have a surface resistance in the range $10^5$–$10^8$ Ω. Adequate conductibility to level the electric field is thus obtained while excessive losses can be avoided.

The device according to the invention may be of different kinds, such as an inductor or a transformer. In the case where the electric device is an inductor, it comprises only one winding in the form of the high-voltage winding.

In the case where the electric device is a transformer, it further comprises a low-voltage winding enclosing the core.

If the electric device comprises a low-voltage winding, it also advantageously comprises a third insulating layer of a solid, electrically insulating material, the low-voltage winding enclosing the second layer and the low-voltage winding being enclosed by a third insulating layer of a solid, electrically insulating material.

By arranging the low-voltage winding outside the high-voltage winding, a maximum distance between the outside of the electric device and the high-voltage winding is obtained. In the case where the electric device has been buried in the ground, for example, the risk of accidentally reaching the high-voltage winding is thus minimized. However, it is, of course, also possible to arrange the low-voltage winding within the high-voltage winding.

According to an embodiment of the present invention, the electric device has the shape of a cable. Owing to its construction, the electric device is well suited for manufacturing in the form of a cable, the cross-sectional dimensions of which can be made relatively small due to the fact that it is manufactured with solid insulation. One advantage of manufacturing the electric device in the form of a cable is that it can be manufactured in a continuous process. The cable can then be delivered to a customer wound onto a drum.

To be able to use the electric device, a cable has to be connected to the high-voltage winding. The connection of the high-voltage winding to the electric cable can be carried out in many different ways. However, high electric fields must be avoided at the connection point between the high-voltage winding and the electric cable. An electric conductor which is connected to the high-voltage winding is preferably enclosed by a fourth insulating layer of an electrically insulating material. The conductor is partly arranged between the first insulating layer and the second insulating layer, the fourth insulating layer being provided with a first corona protection layer of a material exhibiting non-linear resistivity as a function of the electric field along part of the outer side of the fourth insulating layer from the end of the fourth insulating layer that is closest to the winding. The first insulating layer and the second insulating layer are provided with a second and a third corona protection layer, respectively, of the material with non-linear resistivity in stretches each of which, in the longitudinal direction of the core, at least partly overlaps the first corona protection layer.

The fourth insulating layer is advantageously provided with a fifth semiconductive layer which is in contact with both the electric conductor and the fourth insulating layer, and a sixth insulating layer which is in contact with and encloses the fourth insulating layer and is in contact with the first corona protection layer.

The corona protection layers have a high resistivity at low electric fields and a low resistivity at high electric fields. By arranging corona protection layers in this manner, a smooth transition of the electric field from the electric cable to the electric device is achieved. The length of the overlap is determined by the voltage for which the device was designed and by the electric breakdown strength of the air.

Advantageously, the corona protection layer has a surface resistance in the range $10^8$–$10^{12}$ Ω for electric fields below 1 kV/mm.

At electric fields above 1 kV/mm, the corona protection layer advantageously has a surface resistance in the range $10^5$–$10^9$ Ω. Excessively high electric fields are thus avoided as well as excessive losses.

If the electric device has a low-voltage winding intended for a voltage above 1 kV, it is advantageous to have semiconductive layers on both sides of the third electrically insulating layer. The appearance of corona at the low-voltage winding can thereby be prevented.

The high-voltage winding preferably consists of at least one lacquered wire. This allows ordinary electric wire to be used in the high-voltage winding.

To optimize the performance of the electric device, it is desirable that the high-voltage winding should have a certain thickness. It is also desirable to have a certain number of turns of the winding and a certain conductor area in the winding. Because of these requirements the high-voltage winding must be arranged in several layers in order to fit into the space available. However, the voltage between two adjacent layers will be relatively high and there is therefore a risk of breakdown between the different conductor layers. To prevent this problem, the high-voltage winding is advantageously carried out in such manner that it is made up of at least two part windings. Preferably, each of the part windings extends in the longitudinal direction of the core in the range 0.03–2 m. High voltages between conductors in the high-voltage winding, which could lead to breakdown, are thus avoided.

Naturally, part windings of other lengths could be provided depending on, inter alia, the voltage for which the high-voltage winding is intended.

Preferably, cooling channels are provided in the core, said cooling channels being arranged in the longitudinal direction of the core. Satisfactory cooling of the electric device is thus ensured. One advantage of arranging cooling channels in the core is that it is a relatively straightforward and efficient way of cooling the electric device. An alternative to using cooling channels in the core is to provide cooling flanges which enclose the electric device. Of course, such cooling flanges may be provided with cooling channels. Another alternative to cooling is to give the device such an elongate shape that its natural convection will be sufficient for cooling purposes. Preferably, the cooling flanges are made of aluminium, but could also be made of other materials. However, it is preferred to use a material with good thermal conductivity.

According to a further embodiment, longitudinal cooling channels are provided in a cooling flange arranged between the core and the first semiconductive layer. Adequate heat conduction from the inner parts of the electric device is thus obtained.

Advantageously, the electric device further comprises an electric screen which encloses the outer insulating layer. One advantage of the electric screen is that the electromagnetic field from the windings does not interfere with the surrounding equipment.

A plurality of solid materials can be used in the insulating layers. According to a preferred embodiment, the insulating material is silicone. Other examples of suitable materials are polypropylene and crosslinked polyethylene.

According to one aspect of the present invention, a method for manufacturing an electric device is provided. The method is characterised in that it comprises the steps of providing a rod-shaped core of a magnetic material, enclosing the rod-shaped core with a first layer of an electrically insulating material, winding a high-voltage winding around the first layer, and enclosing the high-voltage winding and the core with a second layer of an electrically insulating material which is provided with a semiconductive layer on both sides.

Preferably, the method also comprises the steps of producing a mechanical connection between the second layer and the high-voltage winding, and producing a mechanical connection between the first layer and the core. By providing a mechanical connection, better heat conduction radially outwards from the core is obtained.

Advantageously, the insulating layers are provided in the form of tubes.

Advantageously, the first layer and the second layer are made of electrically insulating shrinkable materials. Advantageously, the method then further comprises the steps of heating the first layer so that it shrinks and makes contact with the core, thereby producing a mechanical connection between the first layer and the core, and heating the second layer so that it shrinks and makes contact with the high-voltage winding, thereby producing a mechanical connection between the second layer and the high-voltage winding.

It is relatively easy to automate such a method. By shrinking on the first and the second layer good contact between the layers and the elements located within the layers is obtained. By providing the insulating layers in the form of tubes, it is relatively easy to achieve insulation in a cheap and rational manner.

Alternatively, the interspace between the first layer and the core or between the second layer and the high-voltage winding is filled with an electrically insulating material. Naturally, both interspaces indicated above can be filled with an electrically insulating material.

Advantageously, the method according to the invention further comprises the steps of providing the inside of the first layer with a first semiconductive layer, providing the outside of the first layer with a second semiconductive layer, providing the inside of the second layer with a third semiconductive layer, and providing the outside of the second layer with a fourth semiconductive layer.

Preferably, the layers are achieved by extrusion. This is a well-established process and allows manufacture of the electric device in a continuous process.

Preferably, the layers are achieved by extrusion, the semiconductive layers being extruded onto the insulating layers in the form of polymer layers into which electrically conductive particles, such as soot particles, have been mixed. This is a simple way of arranging the semiconductive layers on the insulating layers.

Advantageously, the method further comprises the step of winding a low-voltage winding around the second insulating layer after this has been heated. This can also be implemented in a continuous process.

Said steps are advantageously carried out in a continuous process in which the electric device is manufactured in the form of a cable. By manufacturing the electric device in the form of a cable, it can easily be divided into suitably long sections at a later stage.

In the method in general, and in a continuous process in particular, the insulating layers can advantageously be extruded directly onto the core and the high-voltage winding, respectively.

Advantageously, an electric device according to the invention can be used in a number of different ways. To avoid the above-mentioned problem of arranging a heavy transformer at the top of a pole, use can advantageously be made of an electric device suspended from the top of a pole.

In this case, the electric device preferably extends from the top of the pole towards the lower part of the pole.

Such use is particularly advantageous in the case where the electric device is elongated or has the shape of a cable, since an electric device according to the invention catches less wind and has a lower centre of gravity than prior-art devices.

According to a preferred embodiment, the electric device is located inside the pole, so as not to be exposed to the wind, which is the case where it is located on the outside of the pole. Another advantage is that the pole thus forms the housing of the device.

Another example of a situation in which use of an electric device according to the invention is suitable is when arranging the transformer in a cable rack suspended from a roof.

Another example of a situation in which use of an electric device according to the invention is suitable is when the transformer is arranged in a cable trench.

Advantageously, an electric device with three parallel cores and windings according to the invention can be used to transform three-pase high voltage into mains voltage.

In such a three-phase transformer, the cores are advantageously interconnected at both ends so as to close the magnetic flux. Alternatively, it is possible, with an elongate transformer, to twin the three electric devices together only at the ends so as to close the magnetic flux. The fact that the dimension of the electric device can be made relatively small means that the connection of the magnetic field is satisfactory in such use, in particular if the core consists of magnetic wires which are intertwined once the windings have been stripped off.

At frequencies above 150 Hz, it is particularly advantageous to use an electric device according to the invention. At high frequencies, the dimensions of the core can be reduced significantly. With an electric device according to the invention, its total dimensions can be made small since the dimensions of the insulating layers are small.

Advantageously, an electric device according to the invention can be used in railway engines for transforming the voltage taken up by means of current collectors from overhead lines located above the rail. Advantageously, the electric device is then arranged on the top of the engine or under the engine, which ensures satisfactory cooling of the electric device.

Naturally, the above features can be combined in the same embodiment.

To further illustrate the invention, detailed non-limiting embodiments of the invention will be described below.

DESCRIPTION OF PREFERRED EMBODIMENTS

Figure 1:
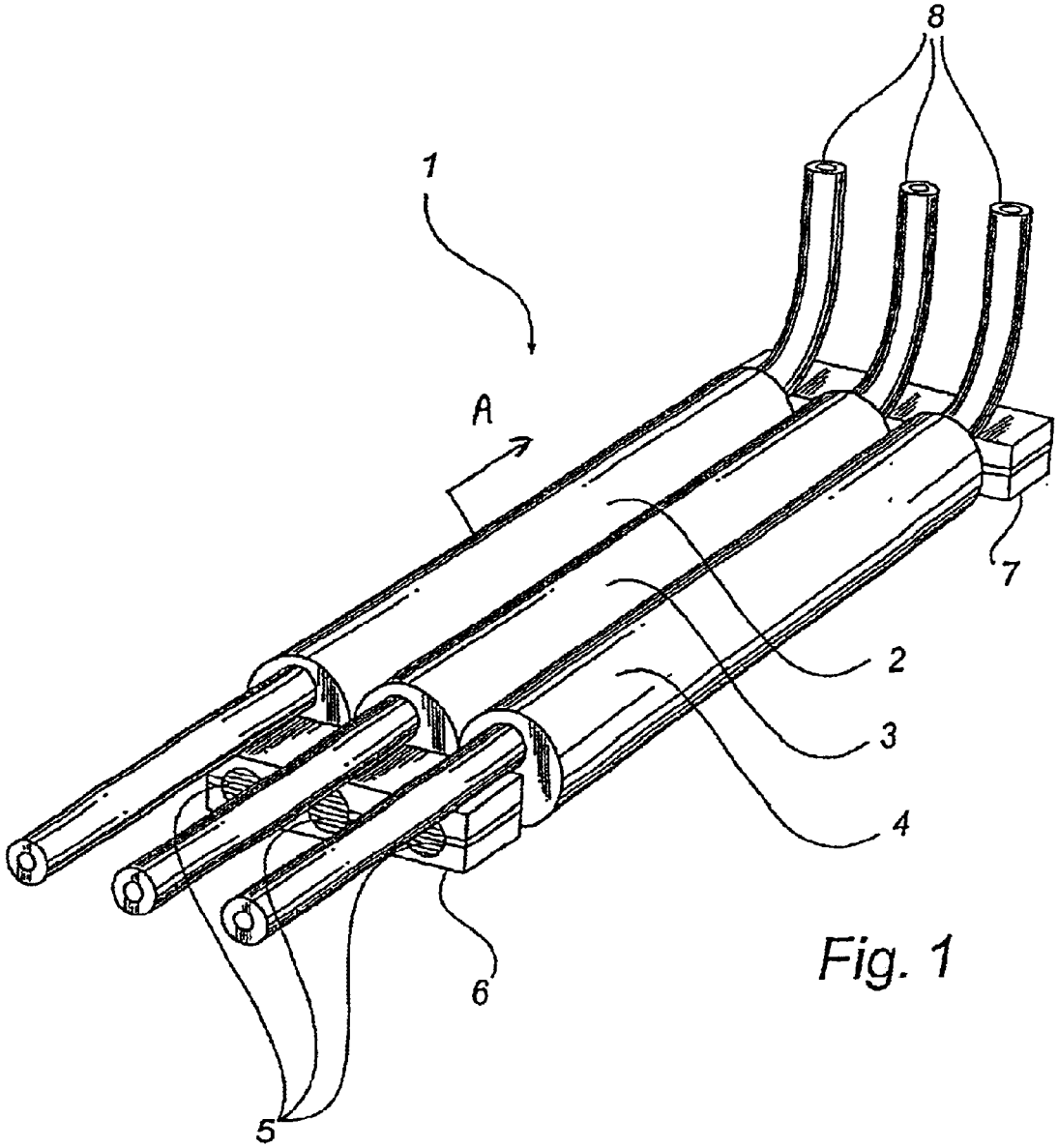
FIG. 1 illustrates an electric device with three interconnected cores according to a preferred embodiment of the present invention.

FIG. 1 shows an electric device according to the present invention in the form of a three-phase transformer 1 consisting of three single-phase transformers 2, 3, 4 according to the present invention. The cores 5 of the single-phase transformers are interconnected by means of yokes 6, 7 at both ends. High-voltage cables 9 are connected to high-voltage windings in the single-phase transformers and low-voltage cables 8 are connected to low-voltage cables in the single-phase transformers. The transformer of FIG. 1 is significantly more elongated than traditional transformers and it may therefore be arranged in long and narrow spaces such as cable trenches and the like.

Figure 2:
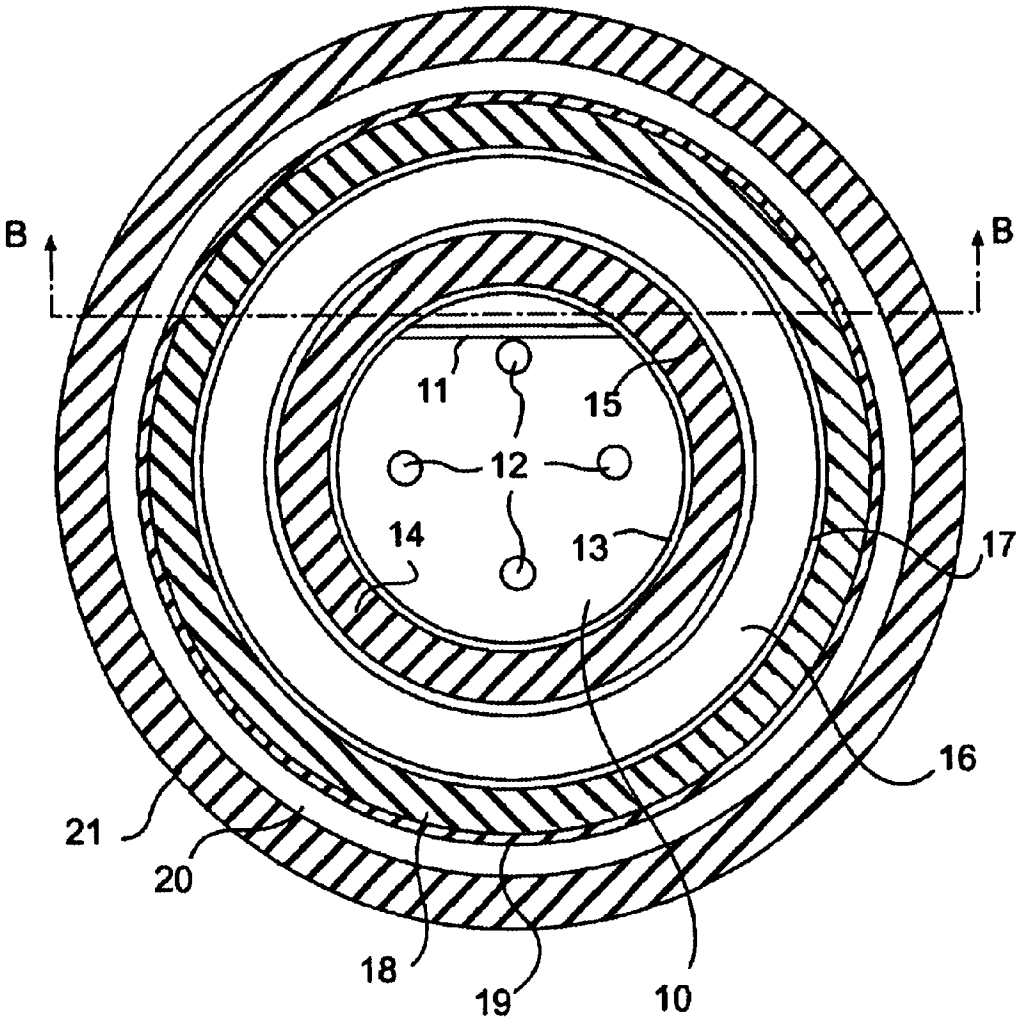
FIG. 2 is a cross-sectional view at A of part of the electric device in FIG. 1.

With reference to FIG. 2, a cross-section of one of the single-phase transformers 2, 3, 4 at A in FIG. 1 is shown. The transformer is intended for transformation from 10 kV high voltage to 400 V mains voltage. The single-phase transformer comprises an iron core 10 which is made up of a plurality of metal sheets 11 extending in the longitudinal direction of the iron core perpendicularly to the plane of the figure. For the sake of clarity, only one plate 11 is shown in FIG. 2. The iron core 10 is enclosed by a first semiconductive layer 13. The thickness of the layer is 0.1–0.5 mm. Cooling channels 12 are provided in the iron core 10 for cooling the transformer. The semiconductive layer 13 is in its turn enclosed by a first insulating layer 14 of a polymer and a second semiconductive layer 15. The first semiconductive layer 13 and the second semiconductive layer 15 are integrated with the first insulating layer 14 and consist of the same kind of polymer as the first insulating layer. However, electrically conductive particles, such as soot particles, have been mixed into the semiconductive layers so as to make the polymer semiconductive. A high-voltage winding 16 is arranged outside the second semiconductive layer. The high-voltage winding preferably consists of lacquered copper wire. The high-voltage winding 16 is enclosed by a second insulating layer 18 which on its inside is covered with a third semiconductive layer 17 and on its outside with a fourth semiconductive layer 19. A low-voltage winding 20 and a third insulating layer 21 are arranged outside the fourth semiconductive layer 19. The function of the semiconductive layers 13, 15, 17, 19 is to level the electric field. The semiconductive layers are arranged as integrated parts of the first insulating layer and the second insulating layer, respectively. The polymer in the insulating layers is, for example, cross-linked polyethylene. The insulating layers are adapted to the voltage for which the transformer is intended and have, in this case, a thickness of 1–3 mm in the case where the transformer is intended for a voltage of 10 kV. The semiconductive layers consist of the same kind of polymer as the insulating layers, the polymer of which has been mixed with soot particles.

A transformer according to FIG. 2 is manufactured by enclosing a rod-shaped core 10 by a first tube 14 of an insulating material provided with a first semiconductive layer 13 on its inside and a second semiconductive layer 15 on its outside. The first tube 14 is then heated so that it shrinks and makes contact with the core 10. In the next step, a high-voltage winding 16 is wound around the first tube 14 and the high-voltage winding 16 and the core 10 are then enclosed by a second tube 18 of an insulating shrinkable material provided with a third semiconductive layer 17 on its inside and a fourth insulating layer 19 on its outside. The second tube 18 is heated so that it shrinks and makes contact with the high-voltage winding 16. Finally, a low-voltage winding 20 is wound around the second tube and a third tube 21 is applied in a corresponding manner outside the low-voltage winding. The insulating tubes are manufactured by extrusion.

According to an alternative embodiment of the present invention, the transformer is manufactured in a continuous process in which a long core 10 is advanced while the insulating layers are extruded onto the core and the windings wound around the same. According to this embodiment, the different steps, as described above, are carried out simultaneously on different parts of the transformer.

Figure 3:
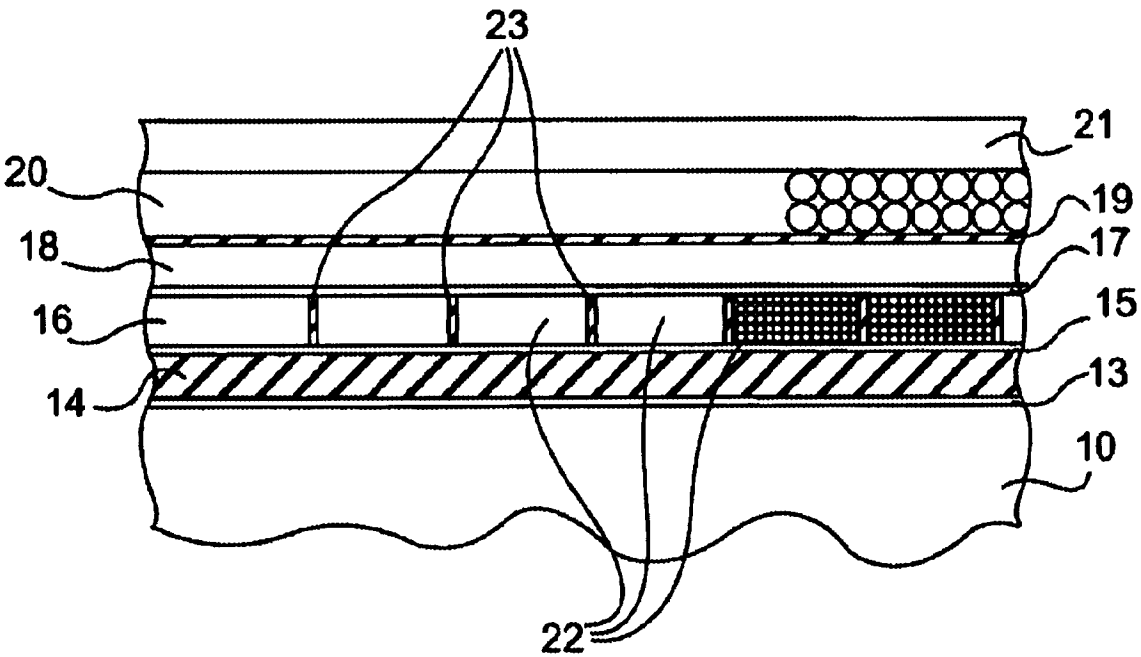
FIG. 3 illustrates the electric device in FIG. 2 along section B—B.

With reference to FIG. 3, the electric device is shown along section B—B in FIG. 2. The figure shows only part of the core 10. The high-voltage winding 16 is divided into a plurality of part windings 22 which are separated by insulating means 23 in the form of polymer washers. The part windings are interconnected so as to form a whole winding. The part windings consist of copper wire wound in a plurality of layers. The voltage between two adjacent wires reaches its maximum at the edge of a winding. The maximum voltage difference between two adjacent wires is dependent on the length of the part winding. The part windings in FIG. 3 are 0.05 m long. The voltage in the low-voltage winding 20 is much lower and, hence, there is no need to divide the low-voltage winding into part windings.

Figure 4:
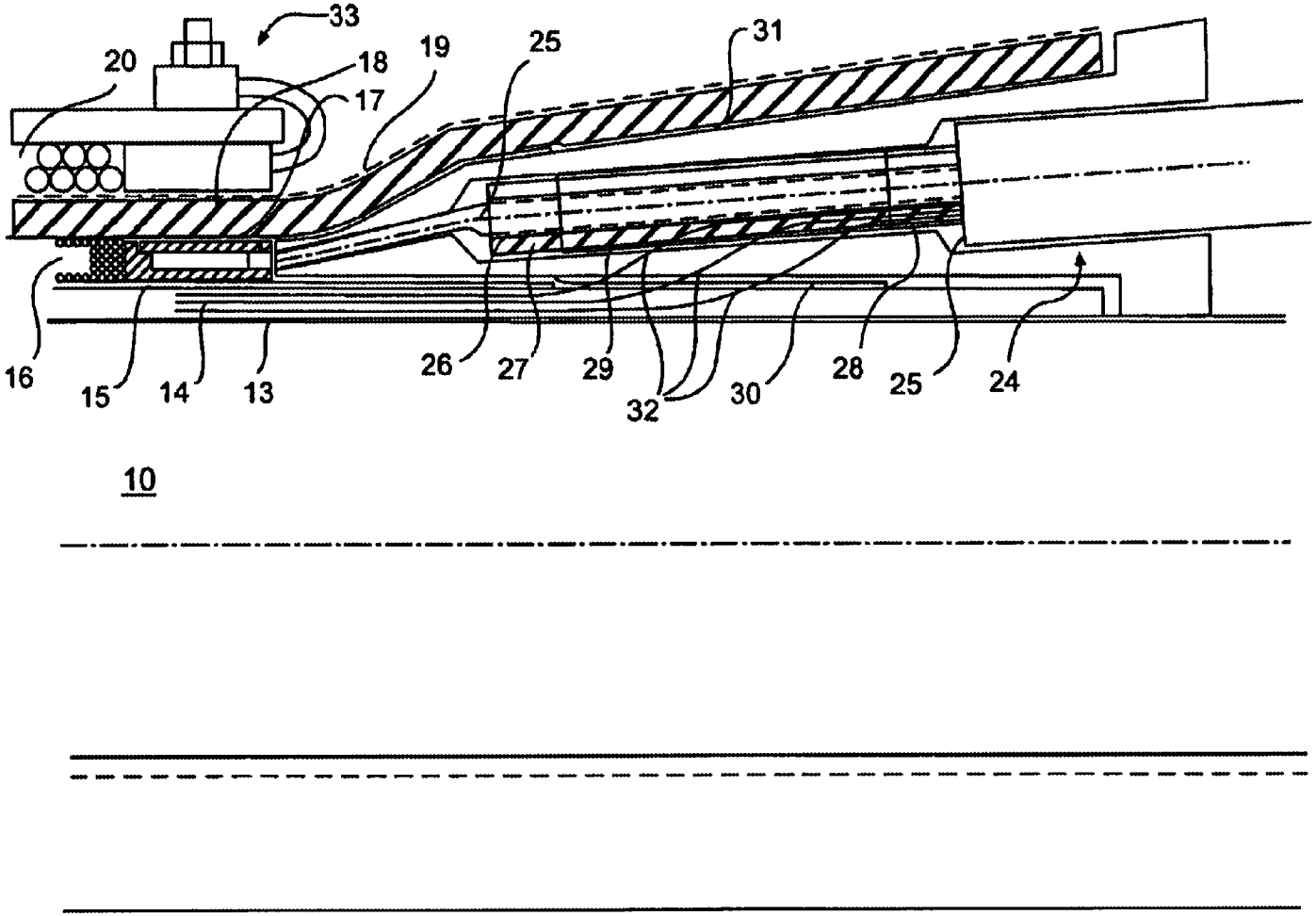
FIG. 4 illustrates the connection of an electric cable to the high-voltage winding of an electric device according to the preferred embodiment of the present invention.

With reference to FIG. 4, a longitudinal section of part of a transformer is shown. The figure illustrates how a high-voltage cable is connected to the high-voltage winding of the transformer. As mentioned above, the first insulating layer 14 is covered with a first semiconductive layer 13 and a second semiconductive layer 15. The high-voltage winding 16 is connected to the conductor 25 of the cable 24. The cable has an outer protective cover. The conductor 25 is enclosed by a fifth semiconductive layer 26, a third insulating polymer layer 27 and a sixth semiconductive layer. The semiconductive layers consist of a polymer with admixed soot particles. The semiconductive layers have a surface resistance in the range $10^5$–$10^8$ Ω. The third insulating layer 27 is covered with a first corona protection layer 29 on the part that is closest to the high-voltage winding. The first insulating layer 14 enclosing the core is covered with a second corona protection layer 30 on the side facing the high-voltage winding and connecting to the second semiconductive layer. The second insulating layer 18 surrounding the core is covered with a third corona protection layer 31, which is arranged on the side facing the high-voltage winding and which is in contact with the third semiconductive layer. The corona protection layers exhibit a non-linear resistivity as a function of the electric field. The surface resistance of the corona protection layer is $10^8$–$10^{12}$ Ω at 1 Kv/mm and $10^3$ Ωm at 100 kV/m. The corona protection layers have a thickness of about 0.3 mm. The function of the corona protection layers is to level the electric field. The electric field is illustrated by the field lines 32 running from the first insulating layer 14 to the fourth insulating layer of the cable. The relatively low resistance of the corona protection layers to high fields will cause the field lines to spread as they pass through the corona protection layers. Excessively high fields in the inevitable air pockets present in the transition between the cable and the transformer will thus be avoided. FIG. 4 also illustrates in greater detail the connection of a low-voltage line to the low-voltage winding 20, said connection being carried out in traditional manner by means of a screw joint 33.

Figure 5:
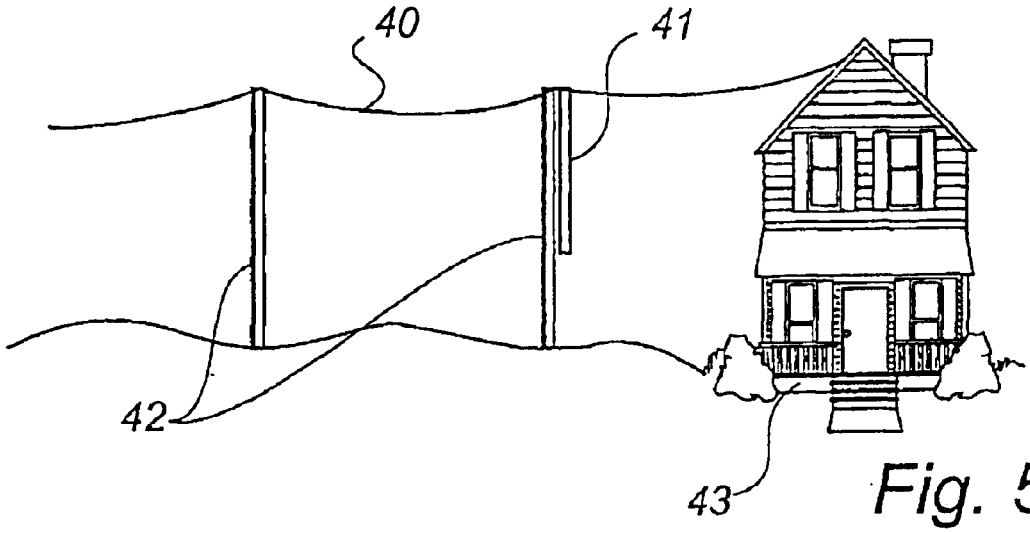
FIG. 5 illustrates the use of a transformer according to the invention, said transformer being suspended from a pole.

With reference to FIG. 5, a basic outline of the use of a transformer according to the preferred embodiment is shown. A high-voltage line 40 for 10 kV is carried on poles 42 to a transformer 41, which steps down the voltage to 400 V before distribution to a consumer, for example a dwelling 43. The transformer 40 is suspended from a pole. Owing to the fact that the transformer has an elongate shape, it catches less wind than a traditional transformer and its centre of gravity is lower.

Figure 6:
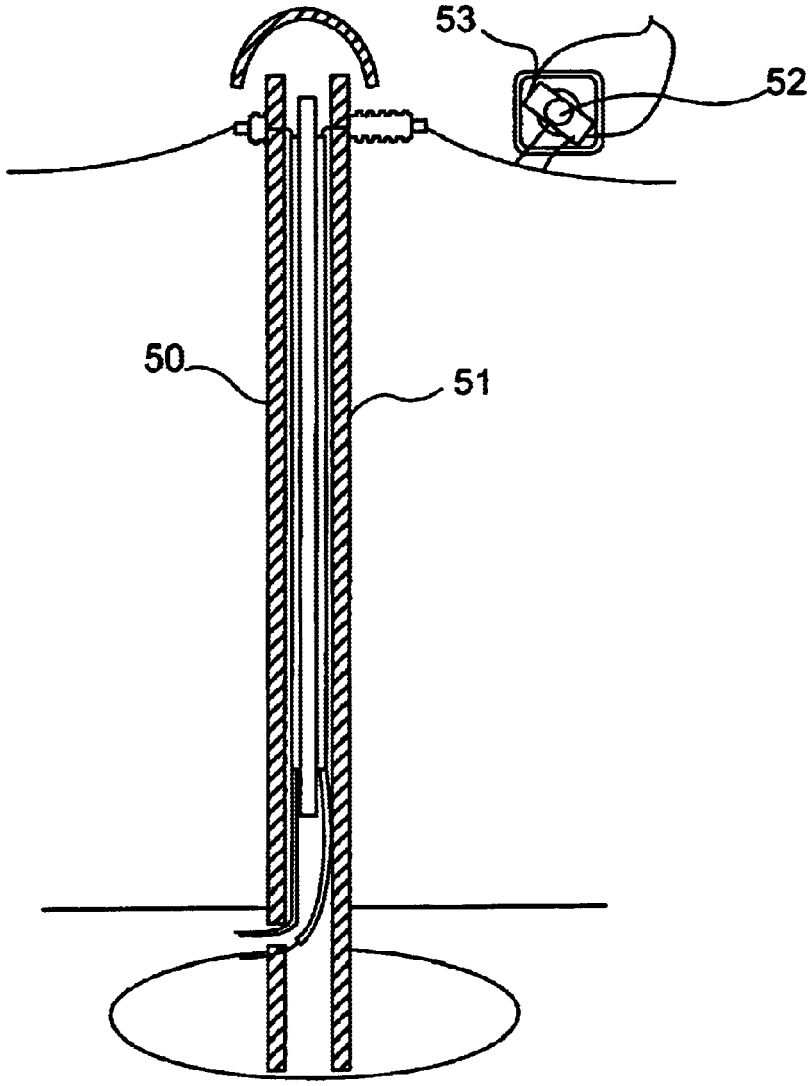
FIG. 6 illustrates the use of a transformer suspended inside the pole.

With reference to FIG. 6, an embodiment of the invention is shown in which a transformer 50 is arranged inside a pole 51. FIG. 6 also shows a cross-section of the pole illustrating how the core 52 is arranged in the centre of the pole and how the flux return feeder 53 is arranged in two opposite corners of the pole.

Figure 7:
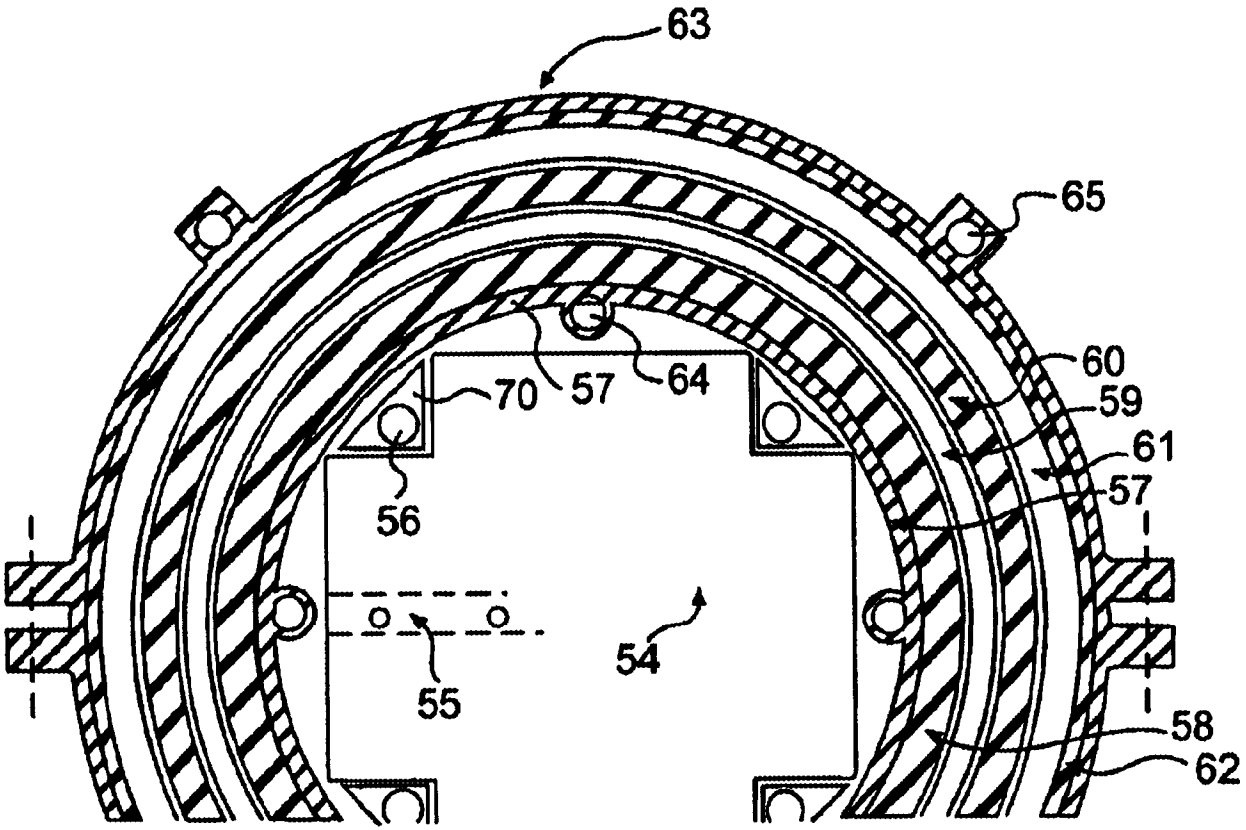
FIG. 7 illustrates a cross section of an electric device according to an alternative embodiment of the present invention, cooling flanges having longitudinal cooling ducts being arranged between the core and the first semiconductive layer and outside the fourth semiconductive layer.

With reference to FIG. 7, a transformer according to an embodiment of the invention is shown. The transformer has a core 54 in which longitudinal cooling conduits 55 are provided for carrying off heat from the core. In addition, cooling sectional elements 70, comprising cooling channels 56, are provided, said sectional elements being in contact with the core 54. A first cooling flange 57, having cooling channels 64, is arranged in contact with a first insulating layer 58, a high-voltage winding 59 in contact with the first insulating layer 58, a second insulating layer 60 in contact with the high-voltage winding 59, a low-voltage winding 61 in contact with the second insulating layer 60 and a third insulating layer 62 in contact with the low-voltage winding 61. The third insulating layer 62 is enclosed by a second cooling flange 63 having cooling channels 65. In a transformer according to the invention, heat is diverted from the outer winding to the second cooling flange 63 and from the inner winding to the first cooling flange 57.

Figure 8:
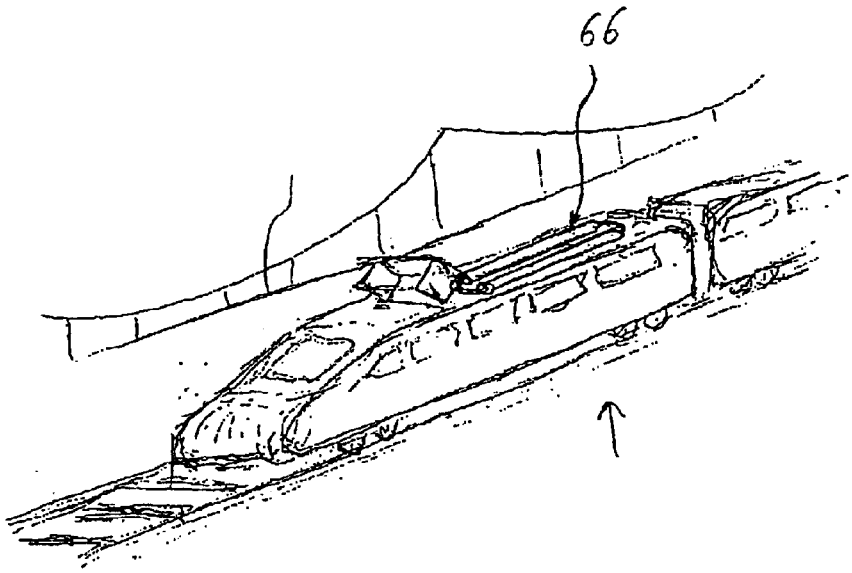
FIG. 8 illustrates a railway engine which is provided with an electric device according to an embodiment of the invention.

FIG. 8 illustrates the use of a transformer 66 according to an embodiment of the present invention. The transformer 66 is arranged on the top of a railway engine 67, but could also be arranged under the engine 67. By using a transformer 66 according to the present invention, the transformer can be located as stated above, which ensures satisfactory cooling of the transformer.

The embodiments described above are given by way of example. It will be appreciated by a person skilled in the art that the above embodiments can be varied in a number of ways within the scope of the invention. For example, four iron cores and their associated windings may be juxtaposed in order to create redundancy in a three-phase transformer.

Naturally, the low-voltage winding may be located closest to the core and the high-voltage winding outside thereof.

Both the high- and low-voltage windings can be adapted for high voltage. In that case, the low-voltage winding is designed similarly to the high-voltage winding with semiconductive layers on both sides of the insulating layer 21. In this case, the transformer is provided with an outer earthed screen (not shown in the drawing) which abuts against the outer semiconductive layer of 21.

Naturally, the tube does not have to be shrunk onto the core. Instead, the gap between the tube and the core can be filled with silicone glue, for example.

Another alternative is to extrude the insulating layers directly onto the core and the windings, respectively.

It is, of course, not necessary to use soot particles in the semiconductive layers. Instead, other substances such as metallic oxides could be used.

What is claimed is:

1. An electric device comprising at least one core (5, 10) of magnetic material and a high-voltage winding (16) in the form of an electric conductor wound around the core, characterised in that it comprises a first insulating layer (14) of a solid, electrically insulating material which encloses the core (10) and which is arranged between the core (10) and the high-voltage winding (16), a first and a second semiconductive layer being arranged on separate sides of the first electrically insulating layer, a second insulating layer (18) of a solid, electrically insulating material enclosing the high-voltage winding (16), a third and a fourth semiconductive layer being arranged on either side of the second electrically insulating layer.

2. An electric device according to claim 1, wherein the first semiconductive layer (13) is in contact with the first insulating layer and enclosed by the first insulating layer (14), the second semiconductive layer (15) is arranged between the first insulating layer (14) and the high-voltage winding (16) in contact with both the first layer and the high-voltage winding (16), the third semiconductive layer (17) is arranged between the second insulating layer (18) and the high-voltage winding (16) in contact with both the second insulating layer (18) and the high-voltage winding (16), and the fourth semiconductive layer (19) is in contact with and encloses the second insulating layer (18).

3. An electric device according to claim 1, wherein the semiconductive layers (13, 15, 17, 19) have a surface resistance in the range $10^5$–$10^8$ Ω.

4. An electric device according to claim 1, wherein the device further comprises a low-voltage winding (20) which encloses the core.

5. An electric device according to claim 1, wherein the device also comprises a third insulating layer (21) of a solid, electrically insulating material, the low-voltage winding (20) enclosing the second insulating layer (18) and the low-voltage winding being enclosed by the third insulating layer (21).

6. An electric device according to claim 1, wherein the device also comprises an electric conductor which is enclosed by a fourth insulating layer (27) of an electrically insulating material and which is connected to the high-voltage winding (16), and which partly is arranged between the first insulating layer (14) and the second insulating layer (18), the fourth insulating layer (27) being provided with a first corona protection layer (29) of a material exhibiting non-linear resistivity as a function of the electric field along part of the outer side of the fourth insulating layer (27) from the end of the fourth insulating layer (27) that is closest to the winding, and the first insulating layer (14) and the second insulating layer (18) being provided with a second corona protection layer (30) and a third corona protection layer (31), respectively, of the material exhibiting non-linear resistivity, in stretches each of which, in the longitudinal direction of the core, at least partly overlaps the first corona protection layer (29).

7. An electric device according to claim 6, wherein the corona protection layers (29, 30, 31) have a surface resistance in the range $10^8$–$10^{12}$ Ω for electric fields with an intensity of less than 1 kV/mm.

8. An electric device according to claim 1, wherein the high-voltage winding (16) consists of at least one lacquered wire.

9. An electric device according to claim 8, wherein the high-voltage winding consists of at least two part windings (22), each having an extent in the longitudinal direction of the core in the range 0.03–2 m.

10. An electric device according to claim 1, wherein cooling channels (12) are provided in the core, said cooling channels (12) being arranged in the longitudinal direction of the core.

11. An electric device according to claim 1, wherein there is provided a cooling flange (63) enclosing the fourth semiconductive layer and comprising cooling channels (65) in the longitudinal direction of the electric device.

12. An electric device according to claim 11, wherein there is arranged a cooling flange (57) between the core and the first semiconductive layer, said cooling flange (57) comprising longitudinal cooling channels (64).

13. An electric device according to claim 1, wherein the insulating layers are made of crosslinked polyethylene, so-called PEX.

14. An electric device according to claim 1, wherein the insulating layers are made of silicone.

15. An electric device according to claim 1, wherein the device also comprises an electric screen enclosing the outermost insulating layer.

16. Use of an electric device, according to claim 1, as a transformer in a rail-mounted vehicle.

17. Use of an electric device, according to claim 1, suspended from the top of a pole (42).

18. Use of an electric device, according to claim 1, suspended between two poles.

19. Use of an electric device, according to claim 1, lying in a cable trench.

20. Use of an electric device, according to claim 1, lying on a cable rack.

21. Use of an electric device, according to claim 1, as a transformer for transforming high voltage into mains voltage.

22. Use according to claim 21, wherein the transformer is located inside the power pole.

23. Use according to claim 16, wherein the cores are interconnected at both ends.

24. Use according to claim 16, wherein an end portion of stripped cores of the devices are twisted around each other to close the magnetic flux.

25. Use of an electric device according to claim 1, at frequencies above 150 Hz.

* * * * *